US009198471B2

(12) United States Patent
Behrend et al.

(10) Patent No.: US 9,198,471 B2
(45) Date of Patent: Dec. 1, 2015

(54) ARTICULATED PROTECTIVE APPARATUS

(71) Applicant: Nike, Inc., Beaverton, OR (US)

(72) Inventors: Carl Behrend, Portland, OR (US); Oliver McLachlan, Portland, OR (US); Catherine F. Morrison, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 275 days.

(21) Appl. No.: 13/804,728

(22) Filed: Mar. 14, 2013

(65) Prior Publication Data

US 2014/0259324 A1 Sep. 18, 2014

(51) Int. Cl.
*A41D 13/015* (2006.01)

(52) U.S. Cl.
CPC ..... *A41D 13/0153* (2013.01)

(58) Field of Classification Search
CPC ..... A41D 13/015; A41D 13/0153; A41D 13/0543; A41D 13/065; A63B 2071/0063; A63B 71/0054
USPC ..... 2/22
See application file for complete search history.

(56) References Cited

U.S. PATENT DOCUMENTS

| | | | | | |
|---|---|---|---|---|---|
| 1,689,558 | A * | 10/1928 | Patten | 2/22 |
| 4,354,280 | A * | 10/1982 | Hayes | 2/16 |
| 4,484,360 | A * | 11/1984 | Leighton et al. | 2/22 |
| 4,868,926 | A * | 9/1989 | Lowson | 2/22 |
| 5,446,926 | A * | 9/1995 | Bourque et al. | 2/22 |
| 5,581,805 | A * | 12/1996 | Rennick | 2/455 |
| 5,924,140 | A * | 7/1999 | Chi | 2/455 |
| 6,065,152 | A * | 5/2000 | Parker | 2/22 |
| 6,105,164 | A * | 8/2000 | Huang | 2/22 |
| 6,519,781 | B1 * | 2/2003 | Berns | 2/267 |
| 2003/0088900 | A1 * | 5/2003 | Cho | 2/22 |
| 2004/0181850 | A1 | 9/2004 | Beland | |
| 2005/0114976 | A1 * | 6/2005 | Beland et al. | 2/22 |
| 2006/0096000 | A1 * | 5/2006 | Romero et al. | 2/22 |
| 2006/0179538 | A1 * | 8/2006 | Dodd | 2/22 |
| 2006/0277644 | A1 * | 12/2006 | Dobkin | 2/24 |
| 2008/0189822 | A1 * | 8/2008 | Johannessen et al. | 2/22 |
| 2009/0070911 | A1 * | 3/2009 | Chang | 2/24 |
| 2009/0100563 | A1 | 4/2009 | Behrend et al. | |

(Continued)

OTHER PUBLICATIONS

International Search Report with Written Opinion dated Jul. 1, 2014 in PCT/US2014/021897, 13 pages.

*Primary Examiner* — Khoa Huynh
*Assistant Examiner* — Jocelyn Wu
(74) *Attorney, Agent, or Firm* — Shook, Hardy & Bacon L.L.P.

(57) ABSTRACT

Aspects of the present invention relate to a protective apparatus that is comprised of an impact shell and an impact attenuating structure. The impact shell includes two discrete portions that are moveably hinged to one another to conform to the underlying protected portion, such as an athlete's shin region. The protective apparatus also utilizes an impact attenuating structure that functions to attenuate an impact force as well as serve as a hinge between the two-part shell. Additional aspects include a puncture prevention element that is positioned between the two shell portions to resist impalement at the hinge junction formed between the two shell portions. Further, additional aspects utilize one or more channels on a posterior surface of the impact attenuating structure to aid in guiding the articulation of the impact attenuating structure in a location related to the shell articulation joint.

4 Claims, 4 Drawing Sheets

(56) References Cited

U.S. PATENT DOCUMENTS

2010/0205724 A1* 8/2010 Kamradt ..... 2/459
2011/0113559 A1* 5/2011 Dodd ..... 5/690
2012/0084896 A1* 4/2012 Wyner et al. ..... 2/16
2012/0180183 A1* 7/2012 Mechling et al. ..... 2/22
2012/0272426 A1* 11/2012 Dodd ..... 2/22
2013/0318675 A1* 12/2013 Mackey ..... 2/22

* cited by examiner

ARTICULATED PROTECTIVE APPARATUS

BACKGROUND

A protective apparatus, such as a shin guard or other padded elements, are traditionally used to limit an impact force experienced by a person or an object. Some examples of protective apparatus rely on foam-like materials that are placed between a protected surface and a point of impact. As part of some certification and testing plans, a protective apparatus must exhibit an ability to resist a puncture. A puncture force may be exerted by a cleat or spike on an opposing player's footwear, for example. However, because a foam-like material may not provide the level of puncture prevention desired, a rigid shell may be used in combination with the foam-like material. However, the rigid shell is not conducive to fitting a variety of wearers not adapting to the desired fit of the wearer.

SUMMARY

Aspects of the present invention relate to a protective apparatus that is comprised of an impact shell and an impact attenuating structure. The impact shell includes two discrete portions that are moveably hinged to one another to conform to the underlying protected portion, such as an athlete's shin region. The protective apparatus also utilizes an impact attenuating structure that functions to attenuate an impact force as well as serve as a hinge between the two-part shell. Additional aspects may include a puncture prevention element that is positioned between the two shell portions to resist impalement at the hinge junction formed between the two shell portions. Further, additional aspects may utilize one or more channels on a posterior surface of the impact attenuating structure to aid in guiding the articulation of the impact attenuating structure in a location related to the shell articulation joint.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
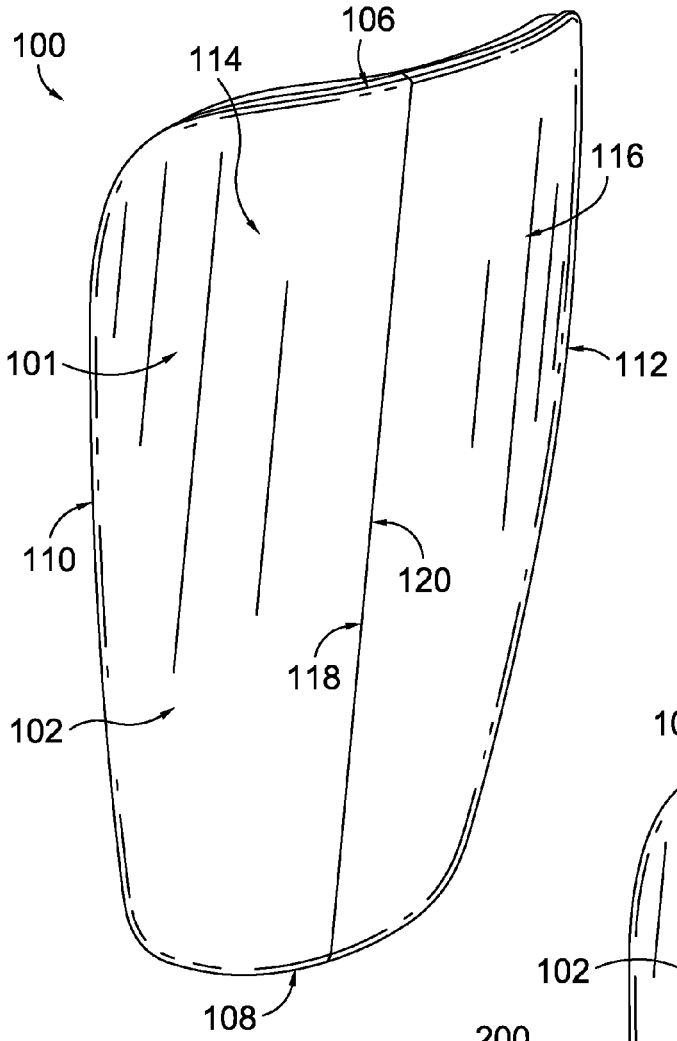
FIG. 1 illustrates an exemplary protective apparatus, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects of the present invention relate to a protective apparatus that is comprised of an impact shell and an impact attenuating structure. The impact shell includes two discrete portions that are moveably hinged to one another to conform to the underlying protected portion, such as an athlete's shin region. The protective apparatus also utilizes an impact attenuating structure that functions to attenuate an impact force as well as serve as a hinge between the two-part shell. Additional aspects include a puncture prevention element that is positioned between the two shell portions to resist impalement at the hinge junction formed between the two shell portions. Further, additional aspects utilize one or more channels on a posterior surface of the impact attenuating structure to aid in guiding the articulation of the impact attenuating structure in a location related to the shell articulation joint.

Accordingly, in one aspect, the present invention provides an articulated protective apparatus. The articulated protective apparatus includes an impact shell having an anterior surface, an opposite posterior surface, a medial edge, an opposite lateral edge, a superior edge, and an opposite inferior edge. The impact shell further comprises a medial shell element extending from the superior edge to the inferior edge and from the medial edge to a medial hinge edge. The impact shell further comprises a lateral shell element extending from the superior edge to the inferior edge and from the lateral edge to a lateral hinge edge. The medial shell element is physically independent of the lateral shell element. The articulated apparatus is further comprised of an impact attenuating structure having a posterior surface, an opposite anterior surface, a medial edge, an opposite lateral edge, a superior edge, and an opposite inferior edge. The impact attenuating structure anterior surface is directly coupled to the posterior surface of the impact shell near a portion of the medial shell element and also near a portion of the lateral shell element.

In another aspect, the present invention provides an articulated protective apparatus having a two-part impact shell. The two-part shell is comprised of an anterior surface and an opposite posterior surface and a medial edge, an opposite lateral edge, a superior edge, and an opposite inferior edge. The two-part impact shell also is formed from a medial shell element extending from the superior edge to the inferior edge and from the medial edge to a medial hinge edge. The two-part shell is also formed from a lateral shell element extending from the superior edge to the inferior edge and from the lateral edge to a lateral hinge edge. The articulated protective apparatus also includes an impact attenuating structure having a posterior surface, an opposite anterior surface, a medial edge, an opposite lateral edge, a superior edge, and an opposite inferior edge. The impact attenuating structure anterior surface is coupled to the posterior surface of the impact shell proximate a portion of the medial shell element and proximate a portion of the lateral shell element. The impact attenuating structure includes a channel extending from the superior edge to the inferior edge of the impact attenuating structure on the posterior surface. Additionally, the articulated protection apparatus includes a puncture prevention element coupled with the impact attenuating structure on the impact attenuating structure anterior surface proximate the channel.

A third aspect of the present invention also provides an articulated protective apparatus comprising a two-part impact shell having an anterior surface and an opposite posterior surface. The posterior surface is curved toward the anterior surface between a medial edge and an opposite lateral edge. The two-part impact shell is comprised of (1) a medial shell element extending from the superior edge to the inferior edge and from the medial edge to a medial hinge edge and (2) a lateral shell element extending from the superior edge to the inferior edge and from the lateral edge to a lateral hinge edge. Further, the articulated protective apparatus includes an impact attenuating structure having a posterior surface and an anterior surface. The impact attenuating structure anterior surface is coupled to the posterior surface of the impact shell near a portion of the medial shell element and also near a portion of the lateral shell element. The impact attenuating structure is comprised of (1)

a hinge channel extending from the superior edge to the inferior edge of the impact attenuating structure on the posterior surface corresponding proximately with the lateral hinge edge; (2) a lateral channel extending from the superior edge to the inferior edge of the impact attenuating structure on the posterior surface between the lateral edge and the hinge channel; and (3) a medial channel extending from the superior edge to the inferior edge of the impact attenuating structure on the posterior surface between the medial edge and the hinge channel. The lateral channel is recessed into the impact attenuating structure a greater amount than the medial channel.

Having briefly described an overview of embodiments of the present invention, a more detailed description follows.

The protective apparatus is contemplated as providing protection to one or more portions of a body or object. For example, it is contemplated that a protective apparatus implementing one or more aspects provided herein may be utilized to provide protection (e.g., puncture prevention) and/or force damping functions to a variety of body parts. Examples include, but are not limited to, shin guards, knee pads, hip pads, abdominal pads, chest pads, shoulder pads, arm pads, and elbow pads. Therefore, it is contemplated that aspects provided herein may be useful in a variety of situations at a variety of locations.

A protective apparatus, as provided herein, is an article for reducing an effect of an impact force on an associated portion of a wearer. For example, a shin guard utilizing features discussed herein may reduce the perception of energy imparted on the shin region of a user through the use of the protective apparatus. This change in perception may be accomplished in a variety of ways. For example, the energy applied at a point of impact may be distributed over a greater surface area, such as through a rigid/semi-rigid impact shell. Further, it is contemplated that a dissipating/absorbing material (i.e., an impact attenuating structure) may provide a compressive function for absorbing and/or dissipating a portion of the impact force. Aspects of the present invention look to provide at least some of the advantages of a protective apparatus (e.g., energy distribution and energy absorption) while reducing some of the disadvantages associated with a traditional non-conforming rigid portions of a protective apparatus.

FIG. 1 illustrates an exemplary protective apparatus 100, in accordance with aspects of the present invention. The protective apparatus 100 is depicted as a shin guard having an impact shell 101 (also referred to as a "shell" herein) that has an anterior surface 102, which is a surface more forward from the wearer when in an as-worn position than an opposite posterior surface (identified as posterior surface 104 in FIG. 3 hereinafter). The posterior surface of the shell 101 is typically closer to the wearer when in an as-worn position than the anterior surface 102. The shell 101 is also defined by a perimeter that is formed from a superior edge 106, a medial edge 112, an inferior edge 108, and a lateral edge 110.

As can be appreciated by one of skill in the art, a shin guard may be produced in a right-leg orientation and a left-leg orientation. Therefore, while one or more orientations are depicted, it is contemplated that concepts similar to those discussed and depicted may be translated to the opposite orientation. Stated differently, while a right shin guard may be discussed herein, it is contemplated that a left shin guard having a mirror-image orientation is also contemplated. Further, human anatomical relational terms are used herein (e.g., medial, lateral, superior, inferior, posterior, and anterior) as general locational terms for reference. However, it is contemplated that alternative aspects may be implemented that are contrary to the terms meaning with respect to a human body. Stated differently, a medial edge of a protective apparatus is contemplated, in an exemplary aspect, of being located proximate a lateral relative location on the wearer, for example.

Returning to the shell 101, it is contemplated that a medial shell element 116 and a separate lateral shell element 114 form the shell 101, at least in part. For example, it is contemplated that the medial shell element 116 and the lateral shell element 114 are the only two elements forming the entirety of the shell 101, in an exemplary aspect. In this example, the medial shell element 116 and the lateral shell element 114 are connected by a flexible joint allowing for the shell to articulate about the joint (e.g., hinge). In an alternative aspect, it is contemplated that three or more elements may be used in conjunction to form the totality of the shell.

The medial shell element 116 is comprised of a medial hinge edge 120 that is opposite the medial edge 112 previously discussed with the shell 101 in the entirety. The medial shell element 116 extends from the superior edge 106 to the opposite inferior edge 108 and between the medial edge 112 and the medial hinge edge 120. A posterior surface and an anterior surface of the medial shell element 116 form a portion of the respective posterior and anterior surfaces 102 of the shell 101.

Similarly, the lateral shell element 114 is comprised of a lateral hinge edge 118 that is opposite the lateral edge 110 previously discussed with the shell 101 in the entirety. The lateral shell element 114 extends from the superior edge 106 to the opposite inferior edge 108 and between the lateral edge 110 and the lateral hinge edge 118. A posterior surface and an anterior surface of the lateral shell element 114 form a portion of the respective posterior and anterior surfaces 102 of the shell 101.

The lateral hinge edge 118 and the medial hinge edge 120 define a physical separation between the lateral shell element 114 and the medial shell element 116, which allows for the shell 101 to flex and articulate as if hinged proximate the separation between the lateral hinge edge 118 and the medial hinge edge 120. This hinge (e.g., articulation joint) allows for a rigid or semi-rigid shell to conform to the shape of the wearer and to move with changes to the underlying form of the wearer (e.g., flexing of a calf muscle, differences in sock/sheath material thickness). Consequently, a common shell geometry may be offered to a variety of different consumers having different sizing needs as the hinged shell can adapt by articulating or bending while still having a functional shell.

A shell is contemplated as being constructed from a number of materials, such as polymer-based materials, infused materials (e.g., carbon-fiber, fiberglass, and aramids), natural materials, metals, and the like. Additionally, it is contemplated that the shell may be constructed from a rapid manufacturing process such as an additive (e.g., laser sintering, polymer deposition) or reductive process. Additionally, it is contemplated that a shell may be constructed from a carbon fiber material comprised of carbon fiber and binders (e.g., resins) to form a durable light-weight material.

The shell is contemplated to provide several functional attributes to the protective apparatus. For example, a force distribution function may be desired. As a result, a rigid or semi-rigid material that is able to distribute a focused force across a larger surface area may be implemented. Similarly, it is contemplated that the shell functions to prevent a puncture. In an exemplary aspect, an opponent may have a cleat or spike on the underside of a shoe that could puncture an inappropriately selected material. As a result, a material, such as those listed above, may be utilized in the shell to resist impalement of the wearer. The prevention of impalement by implementing puncture resistant materials, elements, and geometries will be discussed in greater detail hereinafter with respect to the hinge region formed between the medial shell element 116 and the lateral shell element 114.

While not identified explicitly in FIG. 1, it is contemplated that an impact attenuating structure, such as a padded element, is coupled to the posterior surface of the shell 101. As will be discussed in greater detail hereinafter, the impact attenuating structure may serve several functions. For example, the impact attenuating structure may dissipate and attenuate an impact force experienced by the shell. Further, the impact attenuating structure may serve as a flexible hinge member between the medial shell element 116 and the lateral shell element 114. As a flexible hinge member, the impact attenuating structure allows the articulated protective apparatus to flex while maintain a spatial and relative relationship between the different shell elements.

Figure 2:
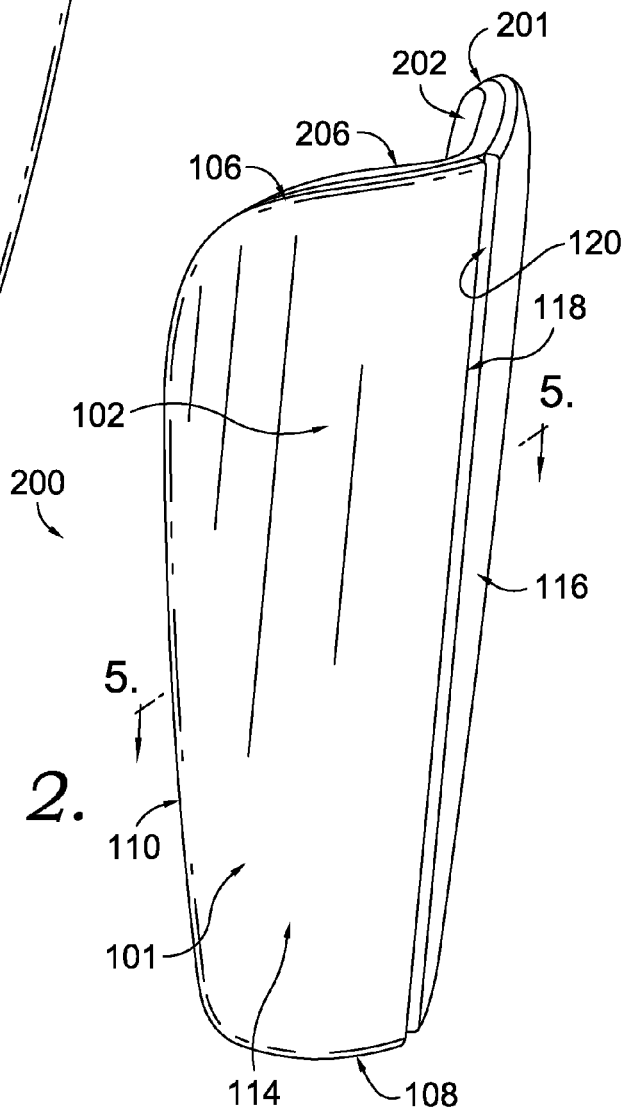
FIG. 2 illustrates a side perspective of an articulated protective apparatus exposing the articulation joint between the medial shell element and the lateral shell element, in accordance with aspects of the present invention.

FIG. 2 illustrates a side perspective of an articulated protective apparatus 200 exposing the articulation joint between the medial shell element 116 and the lateral shell element 114, in accordance with aspects of the present invention. As discussed with respect to FIG. 1 above, the shell 101 is comprised of the superior edge 106, the inferior edge 108, the lateral edge 110, the lateral hinge edge 118, the medial hinge edge 120, the lateral shell element 114, and the medial shell element 116. Additionally depicted is an impact attenuating structure 201 having a posterior surface 202 and an anterior surface along with a superior edge 206.

As illustrated, a hinge is formed between the medial hinge edge 120 of the medial shell element 116 and the lateral hinge edge 118 of the lateral shell element 114. In this example, a gap is less pronounces as the curvature of the posterior surface of the shell 101 is extended in the direction of the anterior surface of the shell 101. Stated differently, as the diameter of a curve of the shell 101 is reduced, a gap expands between the medial shell element 116 and the lateral shell element 114 at the hinge to allow for the articulation of the elements for reducing the curve diameter.

Figure 5:
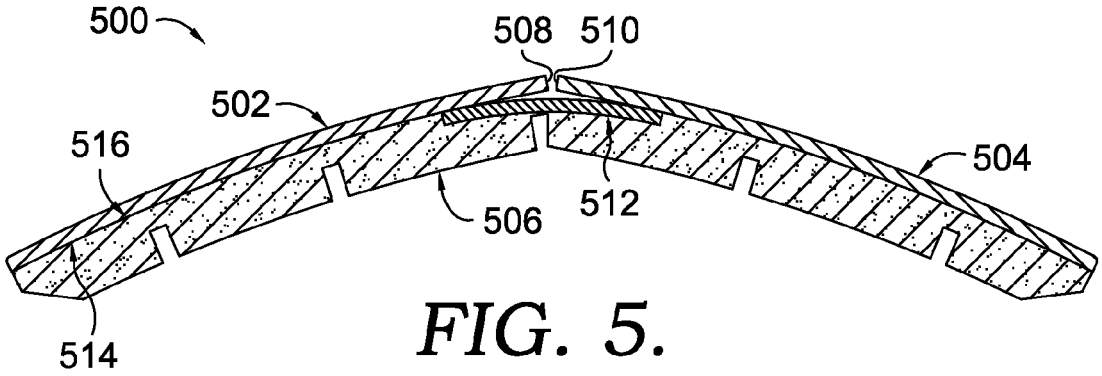
FIG. 5 illustrates a cross sectional view of an articulated protective apparatus along the cutline 5-5 of FIG. 2, in accordance with aspects of the present invention.

Also depicted in FIG. 2 is a cutline 5-5 extending horizontally through the articulated protective apparatus 200 from the lateral edge 110 to the medial edge. The cutline view is illustrated in FIG. 5 hereinafter.

Figure 3:
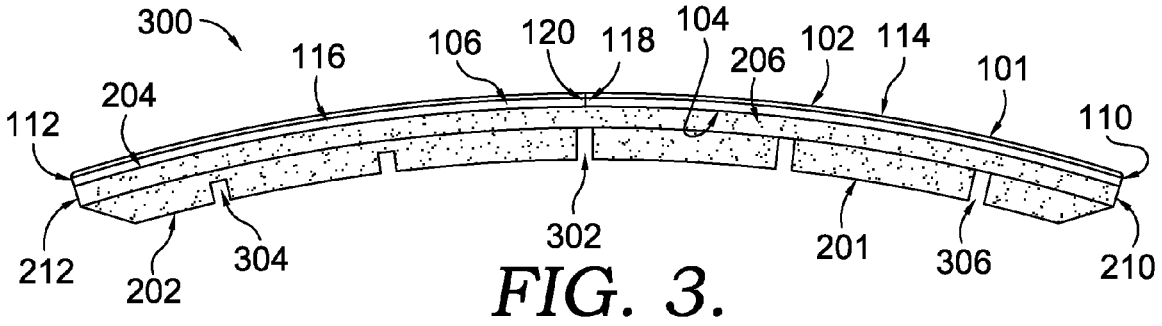
FIG. 3 illustrates a top-down view of an articulated protective apparatus, in accordance with aspects of the present invention.

FIG. 3 illustrates a top-down view of an articulated protective apparatus 300, in accordance with aspects of the present invention. In an exemplary aspect, the articulated protective apparatus 300 is similar to that which was discussed with respect to FIG. 1 and FIG. 2 hereinabove. As previously discussed the articulated protective apparatus 300 is comprised of a shell 101 and an impact attenuating structure 201. The shell 101 is formed with a lateral edge 110, a superior edge 106, a medial edge 112 and an inferior edge (not identified in FIG. 3). Further, the shell 101 is comprised of a medial shell element 116 and a lateral shell element 114. The medial shell element is defined as extending between the medial edge 112 and a medial hinge edge 120. The lateral shell element 114 is defined as extending between the lateral edge 110 and a lateral hinge edge 118. Further, the shell 101 has a posterior surface 104 and an anterior surface 102.

The impact attenuating structure 201 is comprised of an anterior surface 204 and a posterior surface 202. Further the impact attenuating structure 201 is comprised of a superior edge 206, a medial edge 212, and a lateral edge 210. As illustrated, it is contemplated that a continuous impact attenuating structure 201 extends across both the medial shell element 116 and the lateral shell element 114. Therefore, the impact attenuating structure 201 is functional to provide a flexible coupling between the medial shell element 116 and the lateral shell element 114. As illustrated, the lateral edge 210 substantially aligns with the lateral edge 110 and the medial edge 212 substantially aligns with the medial edge 112. However, it is contemplated that the shell 101 may extend past one or more edges (e.g., superior, inferior, medial, lateral) of the impact attenuating structure 201 and/or the impact attenuating structure 201 may extend past one or more edges (e.g., superior, inferior, medial, lateral) of the shell 101, in exemplary aspects.

The impact attenuating structure 201 is also comprised of a number of channels (e.g., grooves, recesses) along at least the posterior surface 202. The channels, as illustrated in greater detail in FIG. 10 hereinafter, may extend in any direction, for any length, at any depth, and at any geometry. In an exemplary aspect, a hinge channel 302 extends from the superior edge 206 downwardly towards an inferior edge of the impact attenuating structure 201. In an exemplary aspect, the hinge channel is substantially parallel with at least one of the medial hinge edge 120 and/or the lateral hinge edge 118. Similarly, it is contemplated that the hinge channel 302 is substantially aligned with and positioned proximate to an articulation joint between the medial shell element 116 and the lateral shell element 114. The hinge channel 302, in an exemplary aspect, provides a crease line along the impact attenuating structure 201 that is more prone to bending than non-channel portions of the impact attenuating structure 201 proximate the articulation joint. Therefore, the hinge channel 302 serves as a hinge for the medial shell element 116 and the lateral shell element 114. Stated differently, the impact attenuating structure 201 proximate the hinge channel 302 serves as an articulating member to which the shell elements are coupled, but remain physically independent of one another.

In addition to the hinge channel 302, a medial channel 304 and a lateral channel 306 are also depicted. The medial channel 304 and the lateral channel 306 may also extend from the superior edge to the inferior edge of the impact attenuating structure 201 in a substantially parallel manner to the hinge channel 302. It is contemplated that the medial channel 304 may recess into the impact attenuating structure 201 a first amount, the hinge channel 302 may extend into the impact attenuating structure 201 a second amount, as depicted. In this example, the medial channel 304 may recess into the impact attenuating structure 201 a lesser amount than the hinge channel 302. Similarly, the lateral channel 306 may recess a third amount into the impact attenuating structure 201. It is contemplated that the first amount, the second amount, and the third amount are different amounts. Further, it is contemplated that first amount is different from the second amount and the third amount, wherein the second amount and the third amount are substantially similar amounts.

The degree of recess of a channel may be altered to accomplish a variety of goals. For example, it is contemplated that the medial channel 304 is more closely oriented to the wearer's tibia bone (i.e., shin) in an as-worn position. Therefore, the reduction in the channel depth increases a volume of impact attenuating material that is effective for attenuating an impact force across the tibia. The greater degree of recess of the hinge channel 302 may allow for the impact attenuating structure 201 to articulate at the hinge channel with greater ease than a shallower recess depth. Further, the greater depth of the hinge channel 302 and the lateral channel 306 may provide for greater ventilation along the wearer's body and a reduction in weight from a reduction in material of the impact attenuating structure 201.

As will be discussed with FIG. 10 hereinafter, it is contemplated that additional or fewer channels may be incorporated within the impact attenuating structure 201 on either the posterior and/or anterior surfaces to accomplish one or more of the functional characteristics (e.g., flexibility, weight reduction, protection, ventilation) provided herein.

The impact attenuating structure may be formed from a variety of materials. For example, it is contemplated that a foam-like material is utilized. Similarly, it is contemplated that an elastomeric polymer may be utilized. Further, it is contemplated that a combination of materials may be utilized in the formation of the impact attenuating structure. For example, a foam core may be maintained between outer layers of a polyurethane-like material to provide a resilient, flexible, washable, and wearable impact attenuating structure material. While specific examples of materials are provided herein, it is contemplated that additional impact attenuating materials may be implemented in one or more portions of the impact attenuating structure 201.

Figure 4:
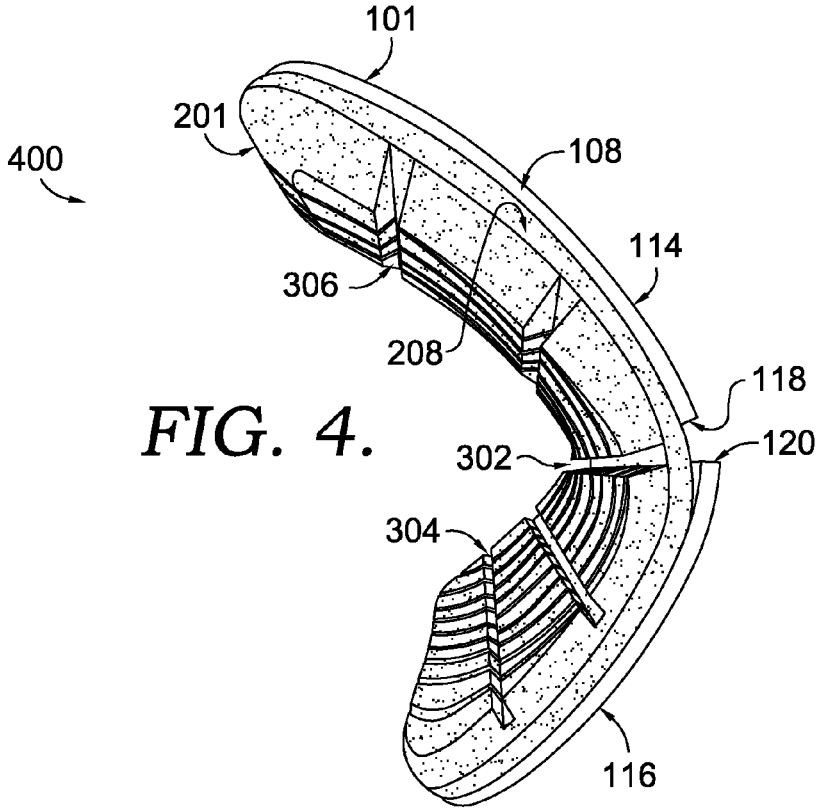
FIG. 4 illustrates an exemplary bottom-up perspective of an articulated protective apparatus in an articulated configuration, in accordance with aspects of the present invention.

FIG. 4 depicts an exemplary bottom-up perspective of an articulated protective apparatus 400 in an articulated configuration, in accordance with aspects of the present invention. The articulated protective apparatus 400 is comprised of a shell 101 formed from a medial shell element 116 and a lateral shell element 114. The medial shell element 116 terminates proximate the lateral shell element 114 at a medial hinge edge 120. The lateral shell element 114 terminates proximate the medial shell element 116 at a lateral hinge edge 118.

The articulated protective apparatus 400 is further comprised of an impact attenuating structure 201 that is comprised of a number of channels, such as a medial channel 304, a lateral channel 306, and a hinge channel 302. As depicted, the hinge channel 302 provides an articulating joint between the medial shell element 116 and the lateral shell element 114.

As depicted in FIG. 4, it is contemplated that the medial shell element 116 is coupled with the impact attenuating structure 201 in a manner that allows a portion of the medial shell element 116 to deflect away from the impact attenuating structure 201. Stated differently, the portion of the medial shell element 116 coupled with the impact attenuating structure 201 may be positioned away from the medial hinge edge 120. It is contemplated that this offset in coupling allows for a greater portion of the impact attenuating structure to serve as an articulation point, which reduces strain and stress on the components during an articulation. However, while the offset coupling is depicted, it is contemplated that the medial shell element may be coupled with the impact attenuating structure 201 at/near the medial hinge edge 120, in an exemplary aspect. While the discussion related to offset coupling is directed to the medial portion, it is contemplated that the lateral portions may equally apply. Further, it is contemplated that both the medial and lateral portions may utilize an offset coupling or only one may utilize an offset coupling.

The coupling between two or more portions may be accomplished using known techniques, such as adhesives and mechanical fasteners. For example, it is contemplated that, but not limited to, glue, epoxy, heat-set adhesive and the like may be applied to one or more portions to be permanently or temporarily coupled. Mechanical fasteners include, but are not limited to, stitching, snaps, rivets, interlocking elements, hook-and-loop fasteners, pockets, and the like. Further, it is contemplated that one or more coupling options may be combined to couple a first portion (e.g., shell element) with a second portion (e.g., impact attenuating structure). In an exemplary aspect, the impact shell and the impact attenuating structure are coupled with an epoxy that forms a permanent bond between the features.

FIG. 5 depicts a cross sectional view of an articulated protective apparatus 500 along the cutline 5-5 of FIG. 2, in accordance with aspects of the present invention. In particular, the protective apparatus 500 is comprised of a shell having a medial shell element 502 and a lateral shell element 504, an impact attenuation structure 506, and a puncture prevention element 512. The puncture prevention element 512 is positioned at least along a hinge joint defined by a medial hinge edge 508 and a lateral hinge edge 510 of the shell. As illustrated, the puncture prevention element 512 is positioned between an anterior surface 516 of the shell and a posterior surface 514 of the impact attenuation structure 506.

In an exemplary aspect, the puncture prevention element 512 is formed from a material that is resistant to impalement (e.g., woven, knit, webbing, mesh). For example, a ballistic-type material, such as a nylon, aramid fiber-based materials (e.g., Poly-paraphenylene terephthalamide), carbon-based materials, and other natural and synthetic materials. For example, it is contemplated that a woven textile made from one or more fiber materials listed above may form a puncture resistant layer that could reduce the potential of impalement through the articulation joint formed between shell portions. Stated differently, the puncture prevention element provides a barrier to impalement at a location formed between the medial hinge edge 508 and the lateral hinge edge 510. As the medial shell element 502 and the lateral shell element 504 are articulated about the articulation joint, the protection from impalement offered by the shell is reduced along the articulation joint; therefore, a secondary puncture protection element is utilized along at least that location.

Therefore, it is contemplated that the puncture prevention element 512 extends between the medial shell element 502 and the lateral shell element 504. It is contemplated that the puncture prevention element 512 extends all of the way from a superior edge to an inferior edge of the shell and/or the impact attenuation structure 506. Further, it is contemplated that the puncture prevention element 512 extends from a medial edge to a lateral edge of the shell and/or the impact attenuation structure 506. Further, as depicted, the puncture prevention element 512 is contemplated as extending to a location between the medial hinge edge 508 and the medial edge and also extending from a location between the lateral hinge edge 510 and the lateral edge.

In an exemplary aspect, the puncture prevention element 512 is coupled with the impact attenuation structure 506 along the anterior surface 516. In an alternative aspect, it is contemplated that the puncture prevention element 512 is coupled with the medial shell element 502 and the lateral shell element 504. Further, it is contemplated that the puncture prevention element 512 is coupled with both the impact attenuation structure 506 and the shell. Further, as previously discussed, the utilization of offset bonding may be utilized in one or more aspects in connection with the puncture prevention element 512.

While not depicted, it is contemplated that the puncture prevention element 512 may also (or in the alternative) be coupled proximate the shell anterior surface. It is contemplated that the impact attenuation structure 506 is maintained between the puncture prevention element 512 and the wearer in order to provide an impalement absorption depth. For example, it is contemplated that the puncture prevention element 512 may stretch, even slightly, in the direction of the impalement force. Because of this stretch, the puncture prevention element 512 may be spaced from the wearer's skin to provide a zone in which the puncture prevention element 512 may absorb the impalement force.

Figure 6:
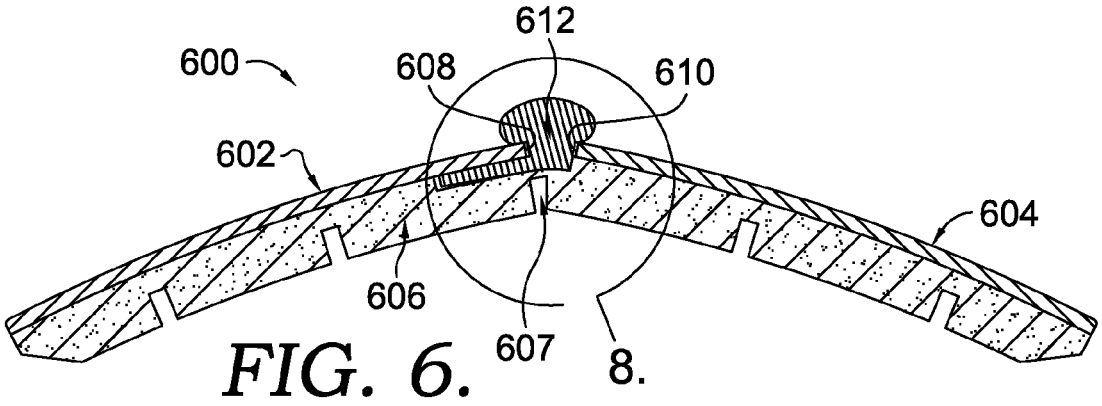
FIG. 6 illustrates a cross sectional view of an articulated protective apparatus along a similar cutline as that depicted in FIG. 5, in accordance with aspects of the present invention.

FIG. 6 depicts a cross sectional view of an articulated protective apparatus 600 along a similar cutline as that depicted in FIG. 5, in accordance with aspects of the present invention. In particular, the protective apparatus 600 is comprised of a shell having a medial shell element 602 and a lateral shell element 604, an impact attenuation structure 606, and a puncture prevention element 612. The puncture prevention element 612 is positioned at least along a hinge joint defined by a medial hinge edge 608 and a lateral hinge edge 610 of the shell. As illustrated, the puncture prevention element 612 is positioned on an anterior surface of the impact attenuation structure 606 between the medial shell element 602 and the lateral shell element 604.

In an exemplary aspect, the puncture prevention element 612 is formed from an elastomeric material. For example, a thermoplastic polyurethane may form the puncture prevention element 612 and be maintained within the articulation joint to fill the gap formed by the articulating shell elements. For example, it is contemplated that the puncture prevention element 612 is elastic in nature to expand/contract to fill a changing articulation joint size. Additionally (or in the alternative) it is contemplated that the puncture prevention element 612 comprises a cap region (614 in FIG. 8 hereinafter) that covers a portion of the anterior surface of both the medial shell element 602 and the lateral shell element 604 along the hinge joint. As the cap region may be sized to extend over the hinge junction regardless of the gap created between the shell elements during a deflection (e.g., bending), the puncture prevention element 612 may not need to dynamically adjust in size as the coverage provided by the cap region may prevent an impalement regardless of the hinge joint deflection size/amount. Other materials are contemplated (e.g., silicone rubber, polypropylene) for forming the puncture prevention element 612.

The puncture prevention element 612 may be couple directly to the medial hinge edge 608 and the lateral hinge edge 610 such that when the two edges extend away from one another during an articulation, the puncture prevention element 612 stretches to fill the widening void. Further, it is contemplated that the puncture prevention element 612 contracts during a reduced deflection to allow the return of the shell elements to a pre-articulation position. The puncture prevention element 612 may also (or in the alternative) be coupled directly with the anterior surface of the impact attenuation structure 606. Further, it is contemplated that the puncture prevention element 612 is maintained in a desired location absent an adhesive or other bonding agent. Instead, as will be discussed in greater detail in FIG. 8, one or more flange portions may extend between the shell and the impact attenuating portion to effectively maintain the puncture prevention element 612 within the articulation joint.

FIG. 6 also depicts a hinge channel 607. The hinge channel 607 is substantially aligned with the puncture prevention element 612, which is also aligned with a hinge joint between the medial hinge edge 608 and the lateral hinge edge 610, in this exemplary aspect.

Figure 8:
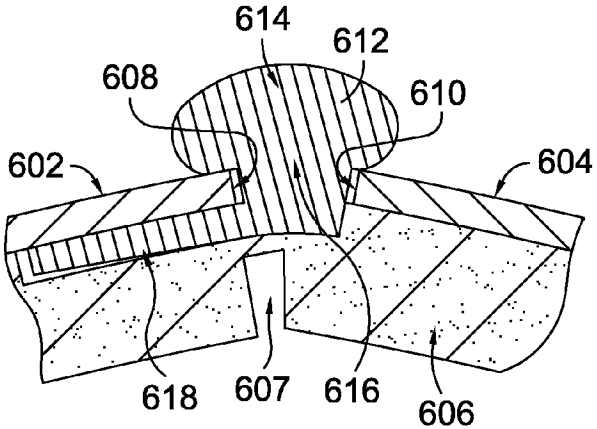
FIG. 8 is an illustration of a puncture prevention element, in accordance with aspects of the present invention.

FIG. 6 depicts a focus region 8, which is highlighted in FIG. 8 hereinafter. FIG. 8 is an illustration of the puncture prevention element 612, in accordance with aspects of the present invention. As discussed with respect to FIG. 6, FIG. 8 depicts the medial shell element 602, the lateral shell element 604, the impact attenuation structure 606, the hinge channel 607, the medial hinge edge 608, and the lateral hinge edge 610. In particular, FIG. 8 demonstrates the puncture prevention element 612 comprised of a cap portion 614, a stem portion 616 and a flange portion 618. It is contemplated that the puncture prevention element 608 may extend the length of the hinge junction (e.g., superior edge to inferior edge).

The cap portion 614 is depicted as having a particular size and geometry; however, it is contemplated that the cap may have any size and/or shape. For example, it is contemplated that the features of the cap portion 614 that are near the anterior surfaces of the medial shell element 602 and the lateral shell element 604 may be rounded in the cross-sectional direction, in an exemplary aspect. The cap portion 614 provides at least two functional advantages. The first advantage is an adjustable hinge joint cover capable of deflecting impalement to the hinge joint regardless of a reasonable articulation-caused separation of the shell elements. A second advantage of the cap portion is to provide a resistance to dislodgement of the puncture prevention element 612. As the cap portion 614 is sized with a greater medial-to-lateral width than the hinge joint, the cap portion resists a posterior movement of the puncture prevention element 612.

The stem portion 616 extends in a posterior direction from the cap portion 614. The stem portion 616 extends between the medial hinge edge 608 and the lateral hinge edge 610 forming the hinge joint. The length of the stem portion may be equal, slightly greater than, or slightly less than the thickness of the shell elements proximate the hinge joint. Stated differently, the stem portion may provide a tying element between the cap portion 614 and the flange 618.

The flange 618 is depicted as extending in a first direction (e.g., medial shell direction in this example). However, it is contemplated that the flange may extend in the opposite direction or both the medial and lateral direction. Therefore, while a backwards "L"-shaped stem and flange combination is depicted, it is contemplated that an upside down "T"-shaped stem and flange combination may be implemented. Further, it is contemplated that an "L"-shaped stem and flange combination may also be utilized. Further, it is contemplated that one or more portion of the stem 616 may be coupled with one or more portions of the shell and/or the impact attenuating structure (with or without a flange 618). Further, it is contemplate that one or more portions of the flange 618 may be couple with one or more portions of the shell and/or the impact attenuating structure to additionally (or alternatively) secure the puncture prevention element 612 in a desired position.

FIG. 8 depicts a portion of the impact attenuation structure 606 removed proximate the medial shell element 602 to accommodate the flange 618. However, it is contemplated that the impact attenuation structure 606 may not incorporate a recessed portion that accommodates the flange 618. Instead, it is contemplated that the flange 618 is merely inserted between an impact attenuation structure 606 anterior surface and the posterior surface of the medial shell element 602, in an exemplary aspect.

Figure 7:
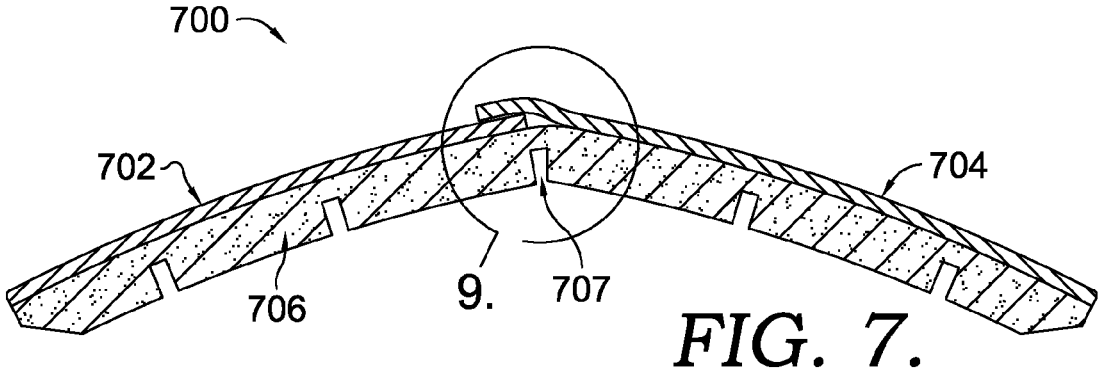
FIG. 7 illustrates a shell overlap puncture prevention arrangement for an articulated protection apparatus, in accordance with aspects of the present invention.

FIG. 7 depicts a shell overlap puncture prevention arrangement for an articulated protection apparatus 700, in accordance with aspects of the present invention. The articulated protection apparatus 700 is comprised of a shell having a medial shell element 704 and a lateral shell element 702. The medial shell element 704 overlaps the lateral shell element 702 at an articulation joint that will be discussed in greater detail at FIG. 9 hereinafter. The overlapping of the lateral shell element 702 by the medial shell element 704 allows the shell elements to be physically separate from one another and therefore able to articulate in the posterior direction while still preventing impalement through the articulation joint. Consequently, an impact attenuating structure 706 may be protected from impalement by this overlapping configuration. The focus region 9 of FIG. 6 identifies region of focus depicted in FIG. 9 hereinafter.

Figure 9:
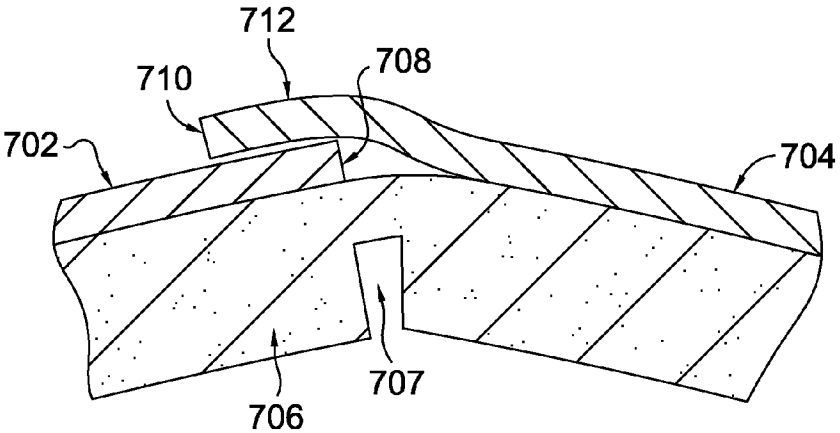
FIG. 9 illustrates a focused view of the articulated protection apparatus of FIG. 7, in accordance with aspects of the present invention.

FIG. 9 depicts the articulated protection apparatus of FIG. 7 with the medial shell element 704, the lateral shell element 702, the impact attenuating structure 706, a medial hinge edge 710, a lateral hinge edge 708, an overlap shell portion 712, and a hinge channel 707. While the medial shell element 704 is depicted as overlapping the lateral shell element 702, it is contemplated that the lateral shell element 702 may overlap the medial shell element 704 in an exemplary aspect.

As depicted, the medial shell element 704 curves in an anterior direction as it approaches the lateral hinge edge 708 allowing the overlap shell portion 712 to overlap the anterior surface of the lateral shell element 702. Further, while the medial hinge edge is depicted as a perpendicular surface to the medial shell element anterior and posterior surfaces, it is contemplated that an angled medial hinge edge may be utilized to deflect an incoming object. Stated differently, it is contemplated that the medial hinge edge may be angled to provide a ramp-like effect to deflect a force originating from a lateral side, in an exemplary aspect.

Figure 10:
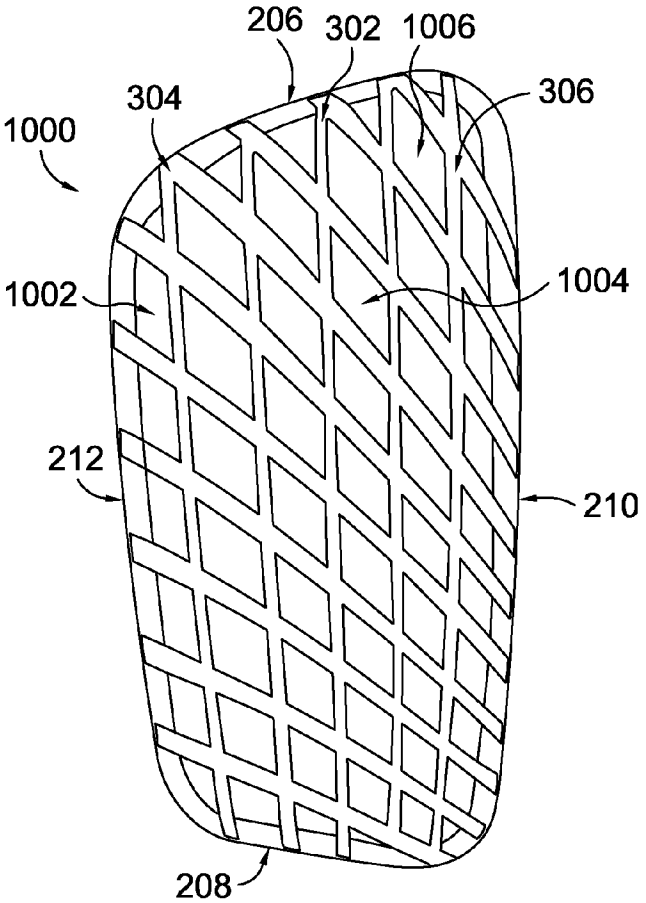
FIG. 10 illustrates a posterior surface of an impact attenuating structure in accordance with aspects of the present invention.

FIG. 10 illustrates a posterior surface of an impact attenuating structure 1000 in accordance with aspects of the present invention. The impact attenuating structure 1000 is comprised of a superior edge 206, an inferior edge 208, a medial edge 212, and a lateral edge 210. Additionally, a number of channels (e.g., recessed regions) are also depicted. For example, a hinge channel 302, a medial channel 304, and a lateral channel 306 are depicted. Also illustrated are a number of formations, such as element 1002, 1004, and 1006. The elements generally extend to the posterior surface and are defined, in part, by the various channels recessed below the impact attenuating structure 1000 posterior surface.

As previously discussed, it is contemplated that one or more channels may be recessed a different amount from a posterior surface than other channel. For example, it is contemplated that the medial channel 304, which may be positioned proximate the tibia bone of a wearer when in an as-worn position, may have a lesser amount of recess from the impact attenuating structure 1000 posterior surface than the hinge channel 302 and/or the lateral channel 306. As previously discussed, the variations in depth for the channels may be utilized to provide specific functions, such as desired impact attenuation, ventilation, weight, balance, feel, fit, and the like.

In an exemplary aspect, the channels of the impact attenuating structure 1000 that run approximately from the superior edge 206 to the inferior edge 208 on a medial side of the hinge channel 302 are recessed into the impact attenuating structure 1000 to a lesser degree than those channels that run approximately from the superior edge 206 to the inferior edge 208 on a lateral side of the hinge channel 302. As the medial side of the impact attenuating structure 1000 is positioned over the tibia region of a wearer when in an as-worn position, a greater degree of impact attenuation is desired in this region, in an exemplary aspect.

While the concepts provided herein discuss the concept of an articulated protection apparatus and depict a shin guard in particular, it is contemplated that this concept extends to all types of force attenuation applications. Additionally, the term "proximate" has been used herein. Proximate is a spatial term that is intended to reflect a locational sense of being close to, near, approximately at, and the like.

The invention claimed is:

1. An articulated protective apparatus comprising:

a two-part impact shell having an anterior surface and an opposite posterior surface and a medial edge, an opposite lateral edge, a superior edge, and an opposite inferior edge;

the two part impact shell further comprising:

(1) a medial shell element extending from the superior edge to the inferior edge and from the medial edge to a medial hinge edge; and (2) a lateral shell element extending from the superior edge to the inferior edge and from the lateral edge to a lateral hinge edge;

an impact attenuating structure having a posterior surface, an opposite anterior surface, a medial edge, an opposite lateral edge, a superior edge, and an opposite inferior edge, the impact attenuating structure anterior surface coupled to the posterior surface of the impact shell proximate a portion of the medial shell element and proximate a portion of the lateral shell element, wherein the impact attenuating structure includes:

a hinge channel extending from the superior edge to the inferior edge of the impact attenuating structure on the posterior surface, a medial channel having a first amount of recess from the impact attenuating structure posterior surface, the medial channel positioned between the medial edge and the hinge channel, a lateral channel having a second amount of recess from the impact attenuating structure posterior surface, the lateral channel positioned between the lateral edge and the hinge channel, the first amount of recess is less than the second amount of recess to provide a greater volume of impact attenuating structure between the medial channel and the two-part impact shell as compared to an amount of volume of impact attenuating structure between the lateral channel and the two-part impact shell, and the second amount of recess is greater than the first amount of recess to provide a larger ventilation structure in the lateral channel as compared to the medial channel; and a puncture prevention element coupled with the impact attenuating structure on the impact attenuating structure anterior surface proximate the hinge channel.

2. The articulated protective apparatus of claim 1, wherein the puncture prevention element is formed from a woven material.

3. The articulated protective apparatus of claim 1, wherein the puncture prevention element is coupled with the medial shell element and the lateral shell element.

4. An articulated protective apparatus comprising:

a two-part impact shell having an anterior surface and an opposite posterior surface, the posterior surface curved toward the anterior surface between a medial edge and an opposite lateral edge;

the two-part impact shell comprised of:

(1) a medial shell element extending from the superior edge to the inferior edge and from the medial edge to a medial hinge edge; and (2) a lateral shell element extending from the superior edge to the inferior edge and from the lateral edge to a lateral hinge edge;

an impact attenuating structure having a posterior surface and an anterior surface, the impact attenuating structure anterior surface coupled to the posterior surface of the impact shell proximate a portion of the medial shell element and proximate a portion of the lateral shell element;

the impact attenuating structure comprising:

(1) a hinge channel extending from the superior edge to the inferior edge of the impact attenuating structure on the posterior surface corresponding proximately with the lateral hinge edge;

(2) a lateral channel extending from the superior edge to the inferior edge of the impact attenuating structure on the posterior surface and positioned between the lateral edge and the hinge channel;

(3) a medial channel extending from the superior edge to the inferior edge of the impact attenuating structure on the posterior surface and positioned between the medial edge and the hinge channel;

(4) the lateral channel recessing into the impact attenuating structure a greater amount than the medial channel to provide a larger ventilation structure in the lateral channel as compared to the medial channel; and (5) the medial channel recessing into the impact attenuating structure a lesser amount than the lateral channel to provide a greater volume of impact attenuating structure between the medial channel and the two-part impact shell as compared to an amount of volume of impact attenuating structure between the lateral channel and the two-part impact shell.

* * * * *